US006164301A

United States Patent [19]

McFadden et al.

[11] Patent Number: 6,164,301

[45] Date of Patent: Dec. 26, 2000

[54] FILTER CLEANING BASIN

[76] Inventors: Michael John McFadden, 1309 Midmeadow Rd., Baltimore, Md. 21286-1606; John Culp McFadden, 8325 Tally Ho Rd., Lutherville, Md. 21093-4720

[21] Appl. No.: 09/063,542

[22] Filed: Apr. 21, 1998

Related U.S. Application Data

[60] Provisional application No. 60/044,488, Apr. 21, 1997.

[51] Int. Cl.[7] ..... B08B 3/04

[52] U.S. Cl. ..... 134/200; 134/201; 134/110; 134/182; 220/799

[58] Field of Search ..... 134/56 R, 57 R, 134/103.1, 111, 169 R, 110, 56 D, 57 D, 58 D, 200, 103.2, 103.3, 173, 174, 179, 180, 181, 182, 183, 197, 192, 162; 312/228; 366/626, 627, 628, 631, 330.1, 270, 265, 314; 220/488, 799, 802, 803, 804, 351; 4/557, 242.1; 422/292, 300, 301, 302, 303; D32/1, 6, 12, 217

[56] References Cited

U.S. PATENT DOCUMENTS

| | | | |
|---|---|---|---|
| 1,495,473 | 5/1924 | Fitzgerald | 134/111 |
| 1,783,194 | 12/1930 | Mcconnell et al. . | |
| 1,807,677 | 6/1931 | Torson | 134/186 |
| 2,385,150 | 9/1945 | Miller | 134/111 |
| 2,568,183 | 9/1951 | Bumpus . | |
| 2,592,857 | 4/1952 | Chadwick | 134/111 |
| 2,593,256 | 4/1952 | Boyer . | |
| 2,646,808 | 7/1953 | Yenne . | |
| 2,675,012 | 4/1954 | Scales . | |
| 2,896,642 | 7/1959 | Lilly . | |
| 3,020,918 | 2/1962 | Albertson et al. . | |
| 3,096,776 | 7/1963 | Dewitt | 134/111 |
| 3,181,541 | 5/1965 | Brooking | 134/186 |
| 3,276,459 | 10/1966 | Harrison . | |
| 3,343,555 | 9/1967 | Kasner | 134/60 |
| 3,566,892 | 3/1971 | Feguson et al. | 134/111 |
| 3,771,539 | 11/1973 | Desantis | 134/111 |
| 3,775,279 | 11/1973 | Boley . | |
| 4,146,404 | 3/1979 | Williams, Jr. . | |
| 4,561,903 | 12/1985 | Blaul | 134/111 |
| 4,773,436 | 9/1988 | Cantrell et al. . | |
| 4,967,776 | 11/1990 | Folmar | 134/115 R |
| 5,385,159 | 1/1995 | Mead | 134/111 |
| 5,649,557 | 7/1997 | Usher | 134/111 |

*Primary Examiner*—Frankie L. Stinson
*Attorney, Agent, or Firm*—Law Offices of Royal W. Craig

[57] ABSTRACT

An improved cleaning basin (including cover and stand) for commercial grill, oven and stove ventilation filters. The device allows convenient soaking and cleaning of the filters in cleaning solution, and provides for safe and efficient drainage of the solution. The device is specially sized to facilitate simultaneous cleaning and soaking of multiple filters in caustic cleaning solution, and it provides for safe and efficient filling and drainage of the solution from the basin. The device is rugged, durable, weather-proof, and it can be manufactured at nominal cost.

6 Claims, 5 Drawing Sheets

FILTER CLEANING BASIN

CROSS-REFERENCE TO RELATED APPLICATIONS

The present application is based on provisional application Ser. No. 60/044,488, filed Apr. 21, 1997.

BACKGROUND OF THE INVENTION

1. Field of the Invention

The present invention relates to cleaning basins and, more particularly, to an improved cleaning basin for commercial grill, oven and stove ventilation filters which allows convenient soaking and cleaning of the filters in cleaning solution, and which provides for safe and efficient drainage of the solution.

2. Description of the Background

Restaurants and commercial kitchens make use of industrial grills, oven and stoves. Pursuant to most sanitation codes, such devices must be equipped with appropriate ventilation fans and duct work. Most standard ventilation intake ducts are equipped with filters comprising mesh filter wire housed in a steel frame. These filters must be periodically removed and cleaned with caustic cleaning solution. The cleaning process entails soaking the filters for extended periods, scrubbing or spraying them down, draining and drying. There are no existing basins, tubs or devices to aid in the process, and the filters are quite often thrown in the sink. Of course, the filters are quite large and only one or two can be cleaned at a time. This makes the process quite time consuming. Moreover, the sink is then occupied and cannot be used for other tasks. Handling of the cleaning solution is even more problematic. The cleaning solution is caustic, yet it splashes around the sink and onto the people doing the cleaning. The situation could easily be remedied by providing an economical cleaning basin for commercial grill, oven and stove ventilation filters which provides for safer and more efficient drainage of the solution.

SUMMARY OF THE INVENTION

It is, therefore, an object of the present invention to provide a heavy duty cleaning basin for commercial grill, oven and stove ventilation filters which is specially sized to facilitate simultaneous cleaning of multiple filters.

It is another object to provide a cleaning basin as described above which allows convenient soaking and cleaning of the filters in caustic cleaning solution, and which provides for safe and efficient filling and drainage of the solution from the basin.

It is yet another object to provide a cleaning basin as described above which is rugged and durable enough to withstand the caustic cleaning solution, and which can weather outdoor placement.

It is another object to provide a cleaning basin with the above-described features which can be manufactured at minimal cost.

In accordance with the above objects, an improved cleaning basin (including cover and stand) is herein disclosed for cleaning commercial grill, oven and stove ventilation filters. The device allows convenient soaking and cleaning of the filters in cleaning solution, and provides for safe and efficient drainage of the solution. The device is specially sized to facilitate simultaneous cleaning and soaking of multiple filters in caustic cleaning solution, and it provides for safe and efficient filling and drainage of the solution from the basin. The device is rugged, durable, weather-proof, and it can be manufactured at nominal cost.

BRIEF DESCRIPTION OF THE DRAWINGS

Other objects, features, and advantages of the present invention will become more apparent from the following detailed description of the preferred embodiment and certain modifications thereof when taken together with the accompanying drawings in which:

FIG. 2 is a front perspective view of a typical fan filter 40 used in ventilating commercial grills, ovens, stoves and the like.

DETAILED DESCRIPTION OF THE PREFERRED EMBODIMENTS

Figure 1:
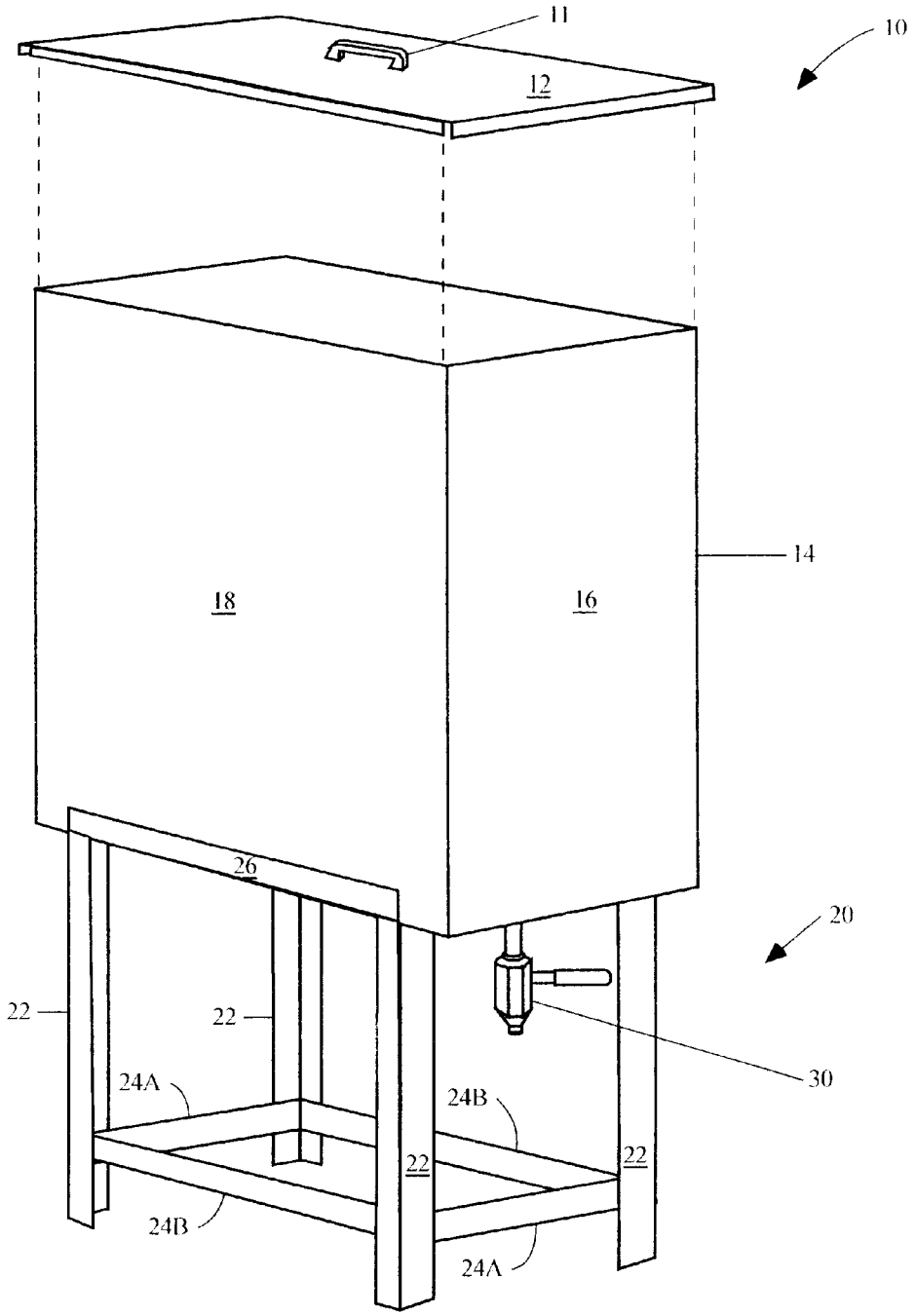
FIG. 1 is a front perspective view of the cleaning assemblage 10 with basin 14, cover cover 12 and floor stand assembly 20.

FIG. 1 illustrates the cleaning assemblage 10 according to the present invention including wash basin 14, cover 12 and floor stand assembly 20.

Basin 14 is a substantially rectangular walled enclosure, open-topped, with a floor panel having a ¾" conduit draining therefrom through a valved spigot 30. The basin 14 is preferably large enough to accommodate at least six filters.

Cover 12 fits atop the basin to close it off for preventing splashing of caustic solution. A handle 11 is provided on top of cover 12 for ease of removal.

Basin 14 may be seated on a uniquely designed four-legged stand 20 which provides excellent lateral and torsional stability.

Figure 2:
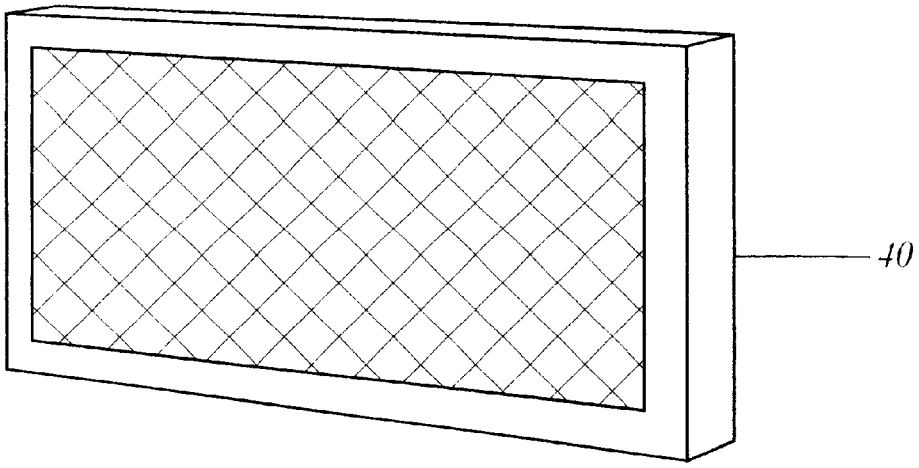

FIG. 2 is a front perspective view of a typical fan filter 40 used in ventilating commercial grills, ovens, stoves and the like. The size of such filters is largely standardized at approximately 2'×24½'×19" (w×l×h).

Figure 3:
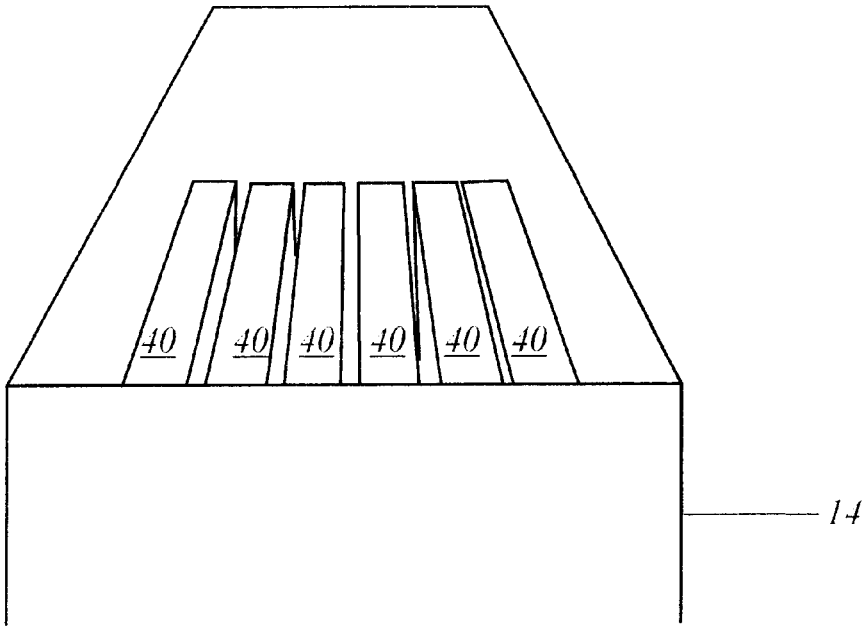
FIG. 3 is an overhead perspective view of the basin 14 with cover 12 removed and a plurality of fan filters 40 seated therein for cleaning.

FIG. 3 is an overhead perspective view of the basin 14 with cover 12 removed and a plurality of fan filters 40 as in FIG. 2 seated in the basin 14 for cleaning. Basin 14 is preferably sized to accommodate at least six of such filters 40, since this will facilitate a single cleaning of all filters employed in most commercial kitchens. The filters 40 are inserted lengthwise into the basin 14 and are seated side-by-side on the floor panel. Once the filters 40 are seated, the appropriate cleaning solution can be poured in from above or, alternatively, pumped in through valved spigot 30. Spigot 30 is a preferably a conventional variable flow valve with a side-mounted on/off lever, and a distal coupling may be used for attachment of a hose.

After the filters 40 are properly seated and the basin is full of cleaning solution, cover 12 is placed overhead. The filters 40 are usually allowed to soak overnight, and may then be scrubbed, dried and removed for use.

The cleaning solution is then drained from the basin. Disposal of the cleaning solution is regulated under the Resource Conservation and Recovery Act as a Corrosive Waste (40 C.F.R. 261.22). OSHA also has regulatory authority, and their applicable material safety data sheet at Section 13 states that waste from normal product use may be served to a public treatment facility in compliance with applicable Federal/Provincial/State/Local/Municipal pre-treatment requirements. For the usual amount of cleaning solution (½ gal.) mixed with 75–100 gallons of water, disposal down the drain appears to be acceptable under the codes. In this case, the spigot 40 is simply positioned over an outside drain and the cleaning solution is emptied. However, if regulations ever prevented disposal of the cleaning solution down the drain, a drain hose can easily be attached at the distal coupling of spigot 40. This way, the cleaning solution can be pumped or siphoned into receptacles for proper waste disposal.

Figure 4:
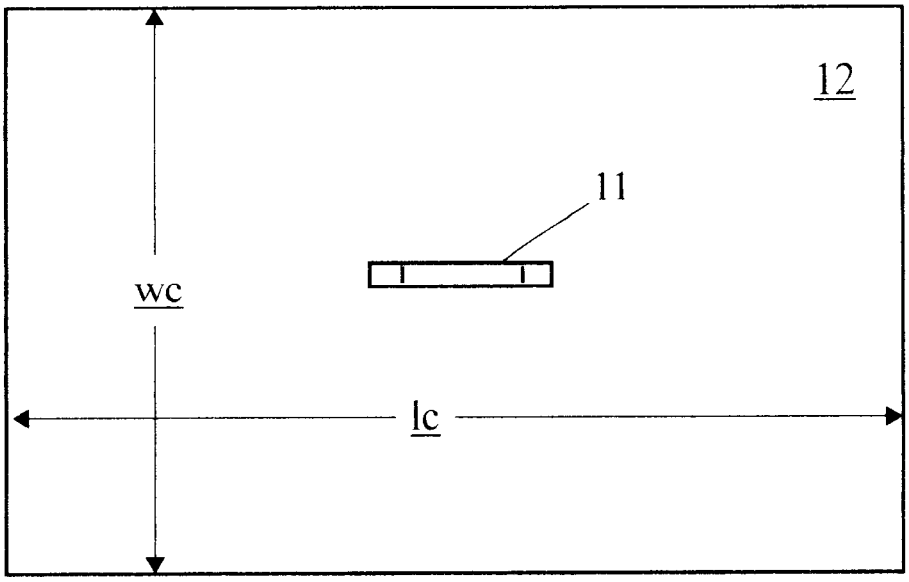
FIG. 4 is an overhead view of the cover 12.

FIG. 4 is an overhead view of the cover 12. Cover 12 is preferably stamped or otherwise formed from a single sheet of galvanized steel or other suitable material capable of withstanding long-term exposure to caustic cleaning solution. Cover 12 may alternatively be molded from heavy duty plastic. An integral handle 11 is provided on top of cover 12 for ease of removal from the basin. Exemplary dimensions for the cover 12 (when used in conjunction with a basin 14 that accommodates six filters) are as follows:

width of cover (wc): 18½"

length of cover (lc): 30"

Figure 5:
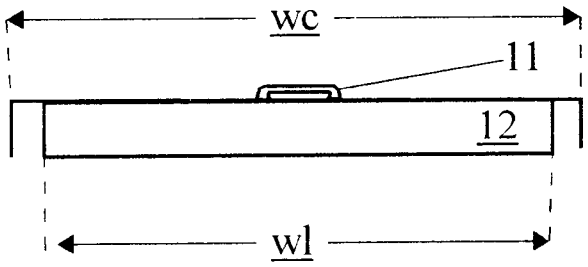
FIG. 5 is a side view of cover 12.

FIG. 5 is a side view of cover 12 with handle 11. As can be seen, the cover 12 is formed with overhanging lips protruding downwardly a short distance from each edge (approximate 1" lips are suitable). These lips correspond to the walls of basin 14 and facilitate seating of the cover 12 thereon. Once cover 12 has been seated atop basin 14, the user is well-protected against splashing of the cleaning solution.

Figure 6:
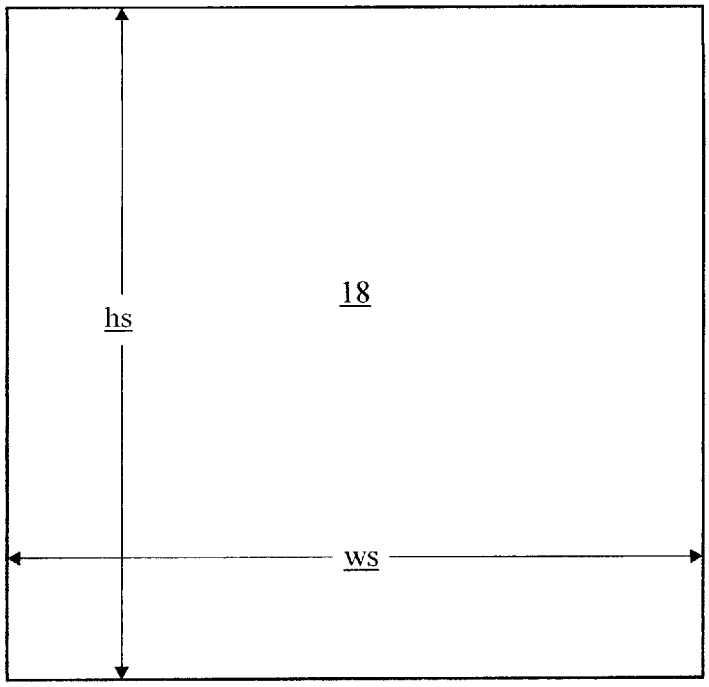
FIG. 6 is a frontal view of a side panel 18 from basin 14.

FIG. 6 is a frontal view of a side panel 18 from basin 14. Two opposing side panels 18 are employed in the present invention, and both are stamped or otherwise formed from sheets of galvanized steel or like material. Side panels 18 may alternatively be molded from heavy duty plastic. Exemplary dimensions for the side panels 18 (when used in conjunction with a basin 14 that accommodates six filters) are as follows:

width of side panel 18 (ws): 30"

height of side panel (hs): 28"

Figure 7:
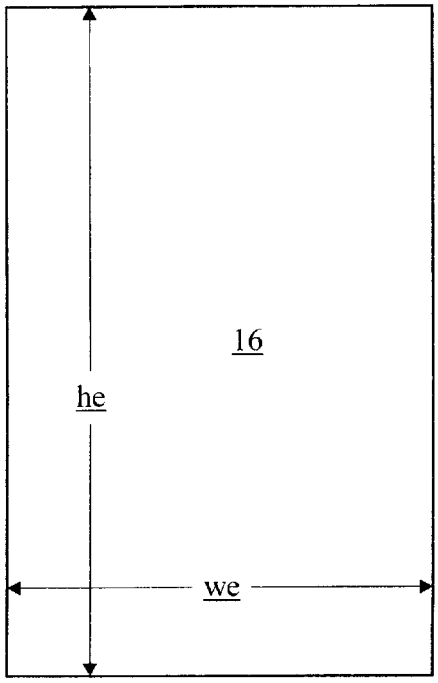
FIG. 7 is a frontal view of an end panel 16 from basin 14.

FIG. 7 is a frontal view of an end panel 16 from basin 14. Two opposing end panels 16 are employed in the present invention, and both are stamped or otherwise formed from sheets of galvanized steel or like material. The two opposing end panels 16 may alternatively be molded from heavy duty plastic. Exemplary dimensions for the end panels 16 (when used in conjunction with a basin 14 that accommodates six filters) are as follows:

width of end panel 16 (we): 18"

height of end panel (he): 28"

In constructing the basin 14, the two end panels 16, side panels 18, and bottom panel are seam welded or otherwise attached to provide a durable watertight rectangular basin.

Figure 8:
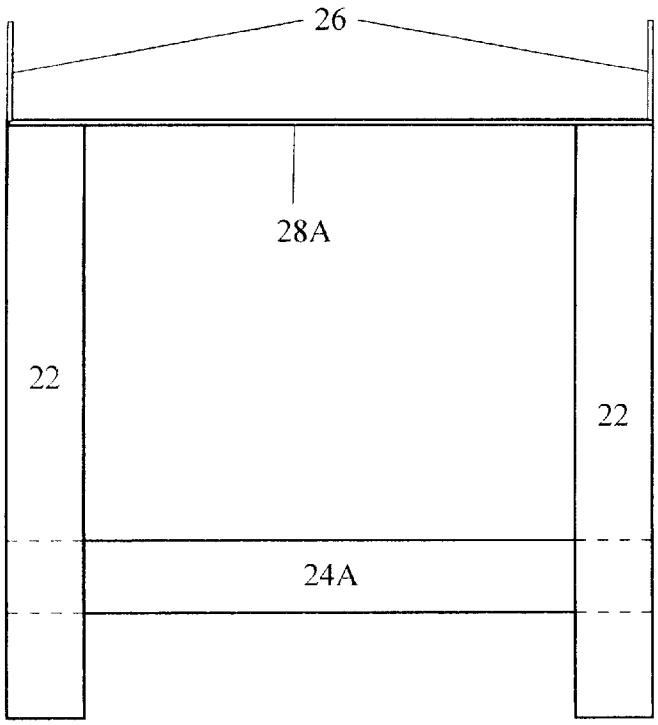
FIG. 8 is a front view of the floor stand assembly 20.

FIG. 8 is a front view of the floor stand assembly 20. Floor stand assembly 20 is an important feature of the present invention inasmuch as it raises the basin 14 to a convenient height and introduces a clearance beneath for proper drainage, and it does so while providing an extremely high degree of stability (supporting upward of 100 lbs of cleaning solution). With this in mind, the particular structure of the floor stand assembly 20 is essential for providing the requisite stability. Four legs 22 are formed each from a right-angled length of cast iron, steel, heavy duty plastic, or other high-strength material. Preferably, all four legs 22 are a uniform 17 ½" long, and may be formed from a right-angled length of ⅛" steel. Opposing pairs of legs 22 are joined at the top by two transverse 18½" beams 28A, and are likewise joined near the bottom by transverse 18½" beams 24A.

Figure 9:
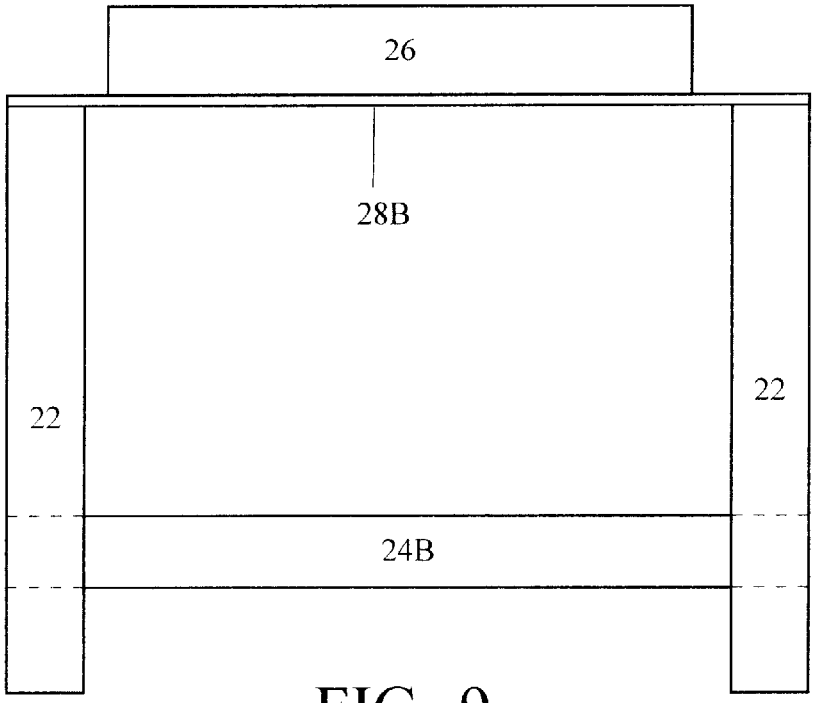
FIG. 9 is a side view of the floor stand assembly 20.

FIG. 9 is a side view of the floor stand assembly 20. The pairs of legs 22 which are joined as described above are joined lengthwise at the top by two transverse 24" beams 28B, and are likewise joined near the bottom by two transverse 24" beams 24B. A pair of lateral braces 26 are attached along the outside edge of beams 28B and protrude upward a short distance. All of the above-described legs 22 and beams 24, 26 and 28 may be welded or otherwise permanently secured together.

In use, basin 14 may be seated on the stand 20 by placing it atop lateral beams 28B and between lateral braces 26. Lateral braces 26 capture the basin 14 and prevent lateral movement during cleaning.

The above-described basin 14 with cover 12 and stand 20 are combined to provide a heavy duty accessory for cleaning commercial grill, oven and stove ventilation filters. The device is specially sized to facilitate simultaneous cleaning and soaking of multiple filters in caustic cleaning solution, and it provides for safe and efficient filling and drainage of the solution from the basin. The device is rugged, durable, weather-proof, and it can be manufactured at nominal cost.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

We claim:

1. A cleaning basin for filters comprising:

a rectangular wash basin adapted to receive a plurality of conventional filters placed side-by-side, said wash basin having a planar bottom panel, two opposing end panels, and two opposing side panels joined to form a fluid-tight container;

a drainage opening located in said bottom panel;

a valved spigot attached to said drainage opening for draining cleaning solution from said wash basin, said valved spigot protruding beneath said bottom panel;

a cover for said wash basin, said cover further comprising a planar top panel, two end panels extending downward from said top panel, and two side panels extending downward from said top panel perpendicular to said side panels, said end panels and side panels terminating with a clearance therebetween to removaby engage the rectangular wash basin when seated thereon, whereby said clearance between the end panels and side panels is adapted to receive an edge of said wash basin to prevent splashing of cleaning solution therefrom; and a free-standing floor stand adapted to removably seat and support said wash basin above the ground to provide convenient access to said plurality of filters and to provide an area directly beneath said wash basin for suspending said valved spigot to allow convenient access thereto for drainage of said cleaning fluid.

2. The cleaning basin for filters of claim 1, said opposing end panels having a width of 18 inches and a height of 28 inches, and said opposing side panels having a width of 30 inches and a height of 28 inches.

3. The cleaning basin for filters of claim 1, said valved spigot further comprising:

a variable flow valve;

a side mounted lever operatively connected to said variable flow valve for selectively opening and closing said variable flow valve; and a distal coupling at a bottom end of said valved spigot configured to receive an end of a fluid conduit for draining said wash basin.

4. The cleaning basin for filters of claim 1, said cover top panel having a handle affixed thereto.

5. The cleaning basin for filters of claim 4, said cover having a width of 18½ inches and a length of 30 inches.

6. The cleaning basin for filters of claim 1, said floor stand further comprising:

four vertical legs, upper horizontal braces extending between each adjacent vertical leg at a top edge of said vertical legs, lower horizontal braces extending between each adjacent vertical leg at a lower portion of said vertical legs; and lateral braces atop two opposing upper horizontal braces for engagement with a bottom edge of each of said opposing side panels of said wash basin, said lateral braces supporting said opposing side panels to prevent lateral movement of said wash basin.

* * * * *